United States Patent [19]

DiMarzio et al.

[11] 4,442,749

[45] Apr. 17, 1984

[54] ELECTRICAL PICKUP FOR A STRINGED INSTRUMENT HAVING FERROMAGNETIC STRINGS

[75] Inventors: Lawrence P. DiMarzio, Staten Island; Steven L. Blucher, New York, both of N.Y.

[73] Assignee: DiMarzio Musical Instrument Pickups, Inc., Staten Island, N.Y.

[21] Appl. No.: 405,892

[22] Filed: Aug. 6, 1982

[51] Int. Cl.[3] ..... G10H 3/18

[52] U.S. Cl. ..... 84/1.15; 84/1.16

[58] Field of Search ..... 84/1.14, 1.15, 1.16

[56] References Cited

U.S. PATENT DOCUMENTS

| | | | |
|---|---|---|---|
| 3,657,461 | 4/1972 | Freeman | 84/1.15 |
| 3,902,394 | 9/1975 | Stich | 84/1.15 |
| 3,915,048 | 10/1975 | Stich | 84/1.14 |
| 3,916,751 | 11/1975 | Stich | 84/1.15 |
| 4,319,510 | 3/1982 | Fender | 84/1.15 |

*Primary Examiner*—Stanley J. Witkowski

*Attorney, Agent, or Firm*—Auslander & Thomas

[57] ABSTRACT

An electrical pickup device for a stringed musical instrument having ferromagnetic strings comprises a pair of superposed coaxial bobbins, each axially wound with a coil having its axis perpendicular to the instrument strings. An integral plate of magnetic material is provided comprising a base disposed between the two bobbins perpendicular to the coil axis and two side walls extending upwardly and perpendicularly from the base to at least immediately below the top face of the upper bobbin. A plurality of rod-like permanent magnets extend through at least the upper coil parallel to the axis thereof and contact the base of the integral plate and the magnets have like polarities at the tops thereof.

4 Claims, 5 Drawing Figures

FIG.1
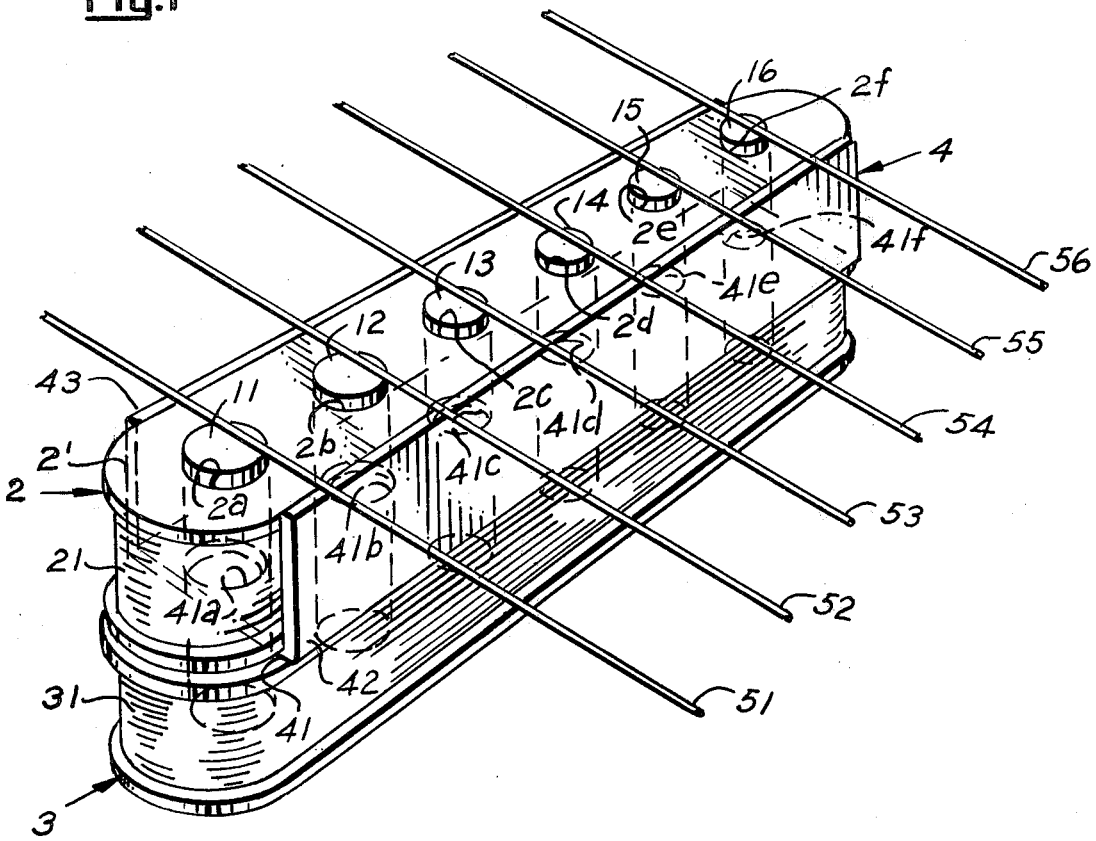
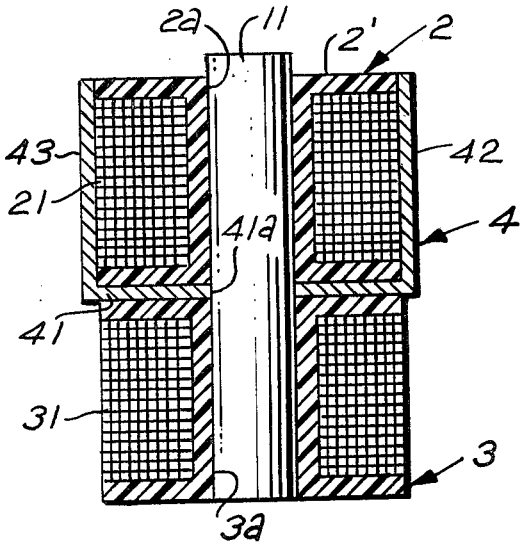
FIG.2
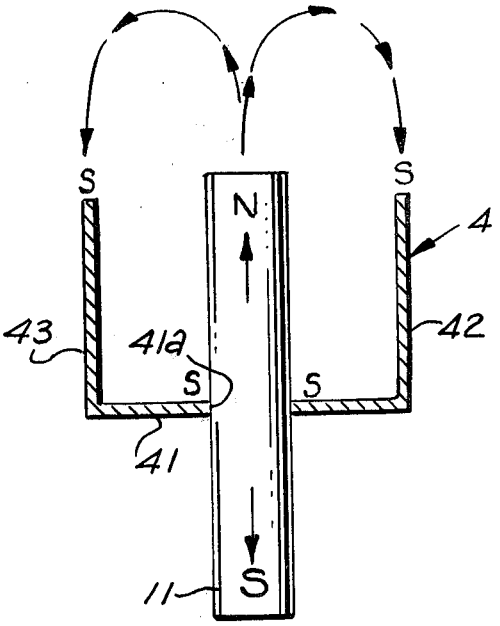
FIG.3

ELECTRICAL PICKUP FOR A STRINGED INSTRUMENT HAVING FERROMAGNETIC STRINGS

BACKGROUND OF THE INVENTION

1. Field of the Invention

The present invention relates to an electrical pickup for a stringed instrument having ferromagnetic strings, such as a guitar.

2. Prior Art

Single coil electrical pickups operating by means of magnetic induction such as those disclosed in U.S. Pat. Nos. 3,588,311 and 3,711,619 tend to couple with the stray magnetic fields produced by electrical devices such as motors, transformers and fluorescent lights. This coupling commonly produces an audible hum in the amplifier and speaker driven by the pickup. This hum commonly has a 60 Hz frequency, due to the use of 60 Hz alternating current power. Prior attempts at the reduction or elimination of this hum have been proposed which utilize two coils disposed side by side with parallel axes such as in U.S. Pat. Nos. 2,896,461, 3,902,394, 3,916,751 and 3,983,777, or with the two coils disposed one above the other, separated by a flat magnetic shield such as in U.S. Pat. No. 3,657,461. The first method causes string vibrations to be sensed over a relatively broad length of string, and results in cancellation of various frequencies, due to the spacing of the coils under the strings. The second method functions effectively as regards reproduction of frequencies generated by the instruments' strings, but has the disadvantage of not producing a strong signal. Additionally, pole legs extending around the strings in single coil pickups have been proposed to reduce hum in U.S. Pat. Nos. 3,236,930 and 4,026,178.

SUMMARY OF THE INVENTION

The main object of the present invention is to provide a two coil pickup device which avoids the disadvantages of the prior art while simply achieving the elimination of hum.

These and other objects of the invention are achieved in accordance with the invention by an electrical pickup device for a stringed musical instrument having ferromagnetic strings, comprising a pair of superposed coaxial bobbins, each axially wound with a coil having its axis perpendicular to the instrument strings, an integral plate of magnetic material comprising a base disposed between the two bobbins perpendicular to the coil axis and two side walls extending upwardly and perpendicularly from the base to at least immediately below the top face of the upper bobbin and a plurality of rod-like permanent magnets extending through at least the upper coil parallel to the axis thereof and in contact with the base of the integral plate and wherein the magnets have like polarities at the tops thereof.

In a preferred embodiment, the base of the integral plate has a plurality of apertures therein and wherein the rod-like magnets extend through the apertures and the lower coil.

Additionally, the two coils are preferably connected in series or parallel, such that current flowing clockwise through one coil will travel counterclockwise through the other. The thin plate of magnetic material is inserted between the two coils with the magnets abutting same or passing therethrough and the plate extends beyond the sides of the bobbins, and is bent perpendicularly to extend upwards to the top face, or immediately below the top face of the upper bobbin. The plate by this means becomes a transmission medium for the directed flow of magnetic force creating an efficient field interaction with the magnets and instrument strings since the two coils are connected together in such a way that an electrical current passing through one coil clockwise will pass through the other coil counterclockwise, and because both copies are so wound as to induce similar voltages, externally generated hum will be substantially reduced.

Although such novel features are believed to be characteristic of the invention and are pointed out in the claims, the invention in the manner in which it may be carried out, may be further understood by reference to the description following and the accompanying drawings, wherein:

BRIEF DESCRIPTION OF THE DRAWINGS

FIG. 1 is a perspective view of a pickup according to the invention shown adjacent to the strings of a musical instrument.

FIG. 2 is an enlarged cross-sectional view, showing the arrangement of the bobbins, and the placement of the transmission plate.

FIG. 3 is a cross-sectional view of the magnetic structure of the pickup according to the invention.

DETAILED DESCRIPTION OF THE PREFERRED EMBODIMENTS

Figure 4:
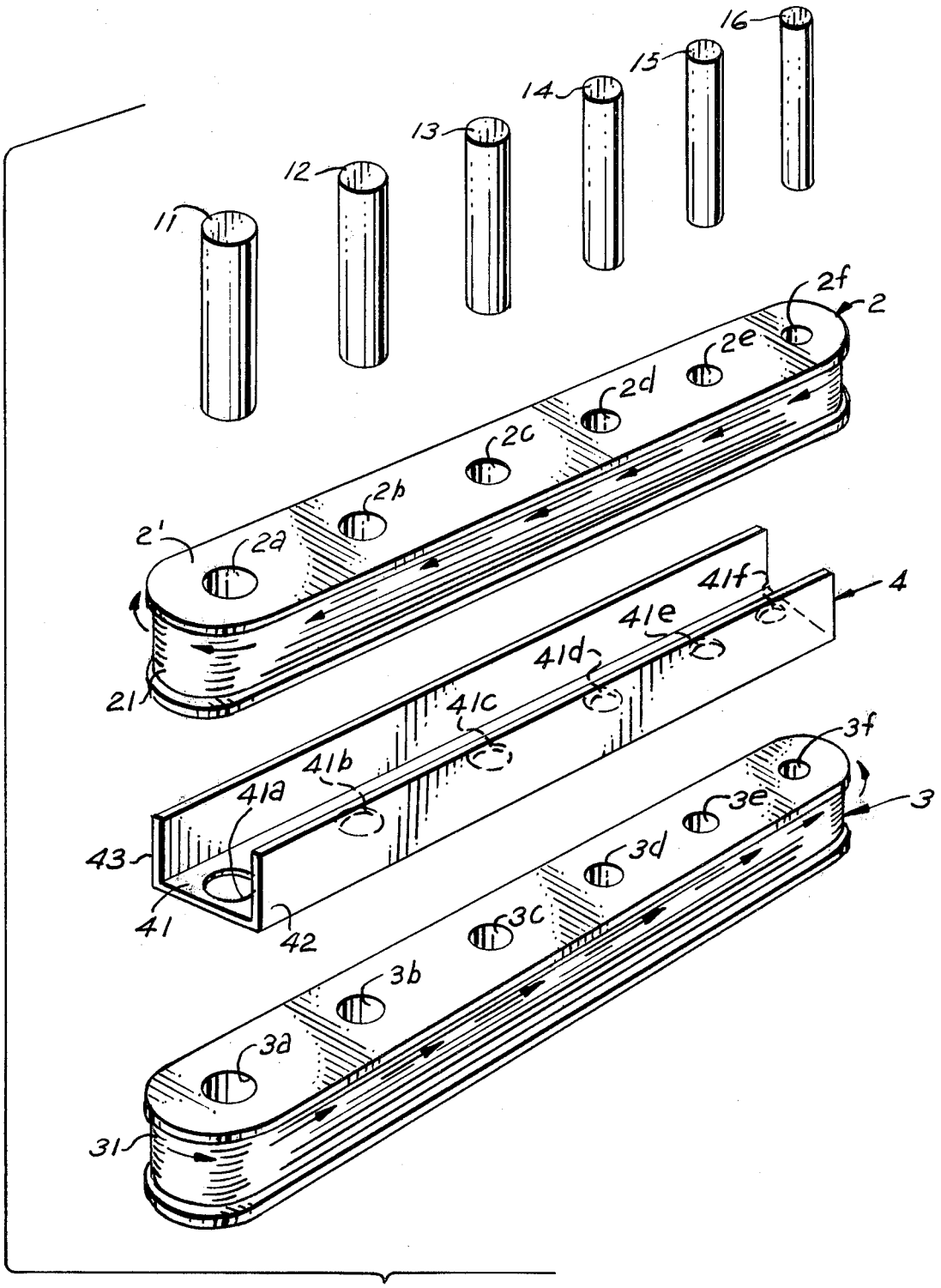
FIG. 4 is an exploded perspective view of the pickup of FIGS. 2–3.

Referring now to FIGS. 1–4, the invention as shown and previously stated is particularly intended for use with an electric guitar. The pickup includes two superposed coaxial bobbins or coil forms, 2 and 3 with bobbin 2 being the upper bobbin and bobbin 3 being the lower bobbin relative to the strings 51–56. 2 and 3 are wound with an appropriate gauge and amount of wire to produce coils 21 and 31 respectively and so that the induced voltage in one coil is equal to the other. The bobbins are separated by, and attached to, plate 4. The plate is constructed from a single piece of metal, preferably iron or another magnetic material, and includes base 41 and is bent so that the sides 42, 43 are perpendicular to the base 41 of the plate, as shown in FIG. 2. The magnets 11–16 are arranged so that they fit through the plate 4, by means of pre-drilled holes 41*a–f*, and both bobbins through holes 2*a–f*. The polarity is lengthwise, so that in the embodiment shown, the north pole of each magnet faces upwards, as shown in FIG. 3. The magnetic field resulting from the arrangement of the magnets 11–16 and plate 4 is shown in FIG. 3. It should be noted that the perpendicular sides 42, 43 of 4 are critical in creating a focused magnetic field immediately above the pickup, so that a string 51–56 vibrating in the field will induce a sufficiently powerful electric current to create high output. Coils 21 and 31 are connected together in series or in parallel so that the current flowing clockwise in 21 will flow counterclockwise in 31. This will enable the cancellation of externally generated hum.

The side walls 42, 43 should extend upwardly to encompass coil 21 to at least immediately below the top surface 2' of bobbin 2.

Figure 5:
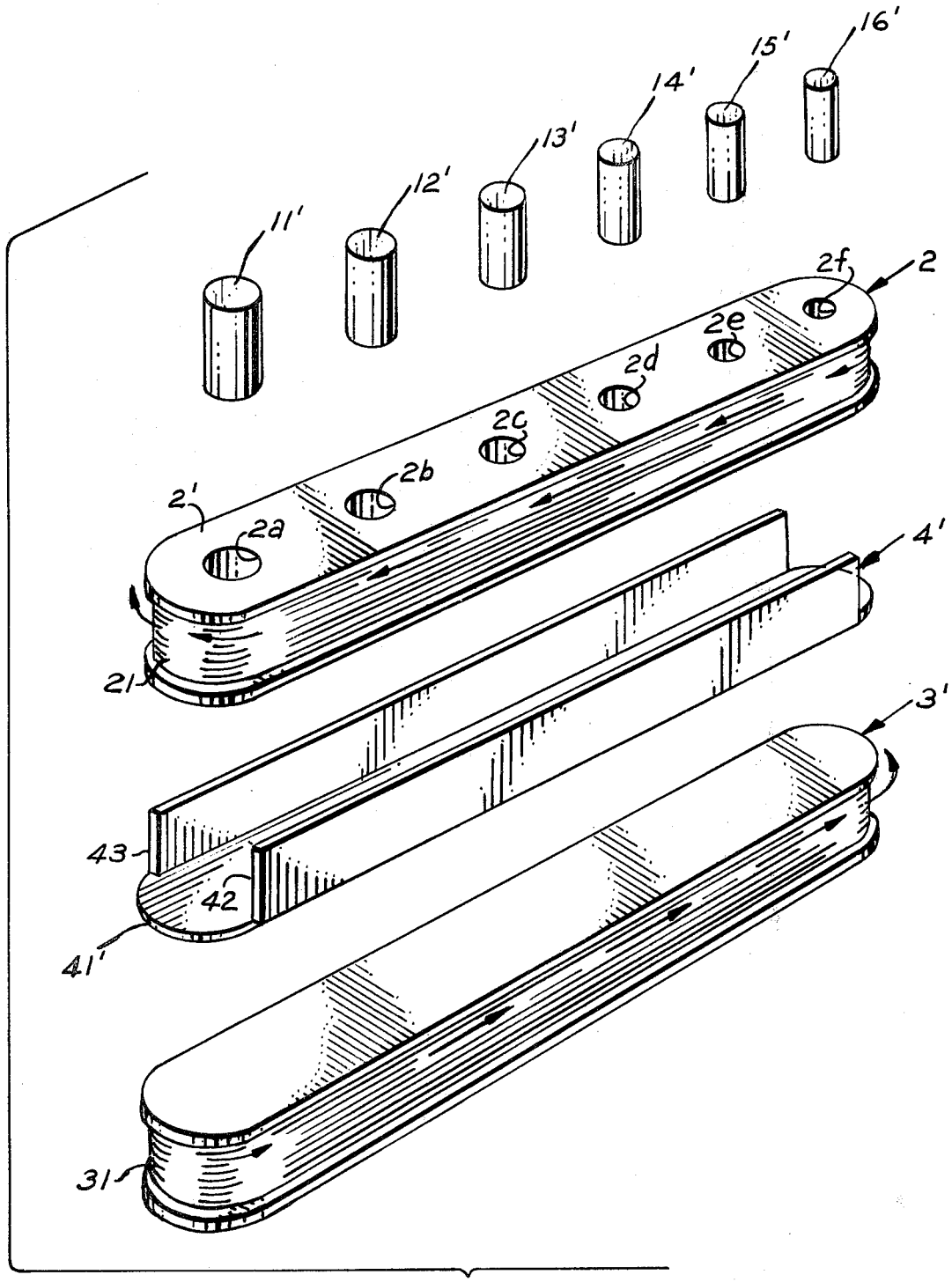
FIG. 5 is an exploded perspective view of an alternative embodiment of the pickup according to the invention.

FIG. 5 illustrates an alternative embodiment wherein plate 4' has a base 41' with no apertures and bobbin 3' has no apertures. In this embodiment magnets 11'–16' are of sufficient length to only extend through holes **2*a–f* in bobbin 2 and thus coil 21 with their bottoms contacting base 41'. In this embodiment, base 41' is also configured to completely separate coils 21 and 31**.

The terms and expressions which are employed herein are used as terms of description only and it is recognized that various modifications are possible within the scope of the invention claimed.

What is claimed is:

1. An electrical pickup device for a stringed musical instrument having ferromagnetic strings, the device comprising:

a. a pair of superposed coaxial bobbins, each axially wound with a coil having its axis perpendicular to the instrument strings;

b. an integral plate of magnetic material comprising a base disposed between the two bobbins perpendicular to the coil axis and two side walls extending upwardly and perpendicularly from the base to at least immediately below the top face of the upper bobbin; and c. a plurality of rod-like permanent magnets extending through at least the upper coil parallel to the axis thereof and in contact with the base of the integral plate and wherein the magnets have like polarities at the tops thereof.

2. The device according to claim 1, wherein the base of the integral plate has a plurality of apertures therein and wherein the rod-like magnets extend through the apertures and the lower coil.

3. The device according to claim 1 or 2, wherein the two coils are connected in parallel such that current flowing clockwise through one coil will travel ounter-clockwise through the other.

4. The device according to claim 1 or 2, wherein the two coils are connected in series such that current flowing clockwise through one coil will travel counter-clockwise through the other.

* * * * *